US005394230A

United States Patent [19]

Kaukeinen et al.

[11] Patent Number: 5,394,230

[45] Date of Patent: Feb. 28, 1995

[54] METHOD AND APPARATUS FOR FORMING A COMPOSITE DRY TONER IMAGE

[75] Inventors: Joseph Y. Kaukeinen; Eric C. Stelter, both of Rochester; Joseph E. Guth, Holley, all of N.Y.

[73] Assignee: Eastman Kodak Company, Rochester, N.Y.

[21] Appl. No.: 64,625

[22] Filed: May 20, 1993

[51] Int. Cl.[6] ..... G03G 15/01

[52] U.S. Cl. ..... 355/326 R; 430/42

[58] Field of Search ..... 430/42, 46, 55; 355/326

[56] References Cited

U.S. PATENT DOCUMENTS

| | | | |
|---|---|---|---|
| 3,703,335 | 11/1972 | Hoffman et al. | 355/51 |
| 4,756,985 | 7/1988 | Haneda et al. | 430/42 |
| 4,778,740 | 10/1988 | Takashima et al. | 430/42 |
| 4,961,094 | 10/1990 | Yamaoki et al. | 355/326 |
| 5,001,028 | 3/1991 | Mosehauer et al. | 430/45 |
| 5,025,292 | 6/1991 | Steele | 355/326 |
| 5,053,821 | 10/1991 | Kanugi et al. | 355/245 |
| 5,112,710 | 5/1992 | Shimura et al. | 430/46 |
| 5,159,389 | 10/1992 | Minami et al. | 355/211 |

*Primary Examiner*—John Goodrow

*Attorney, Agent, or Firm*—Leonard W. Treash

[57] ABSTRACT

A process of forming a composite toner image, for example, a two color image, includes steps of charging and exposing an image member to create a first electrostatic image and developing the image to form a first toner image. The process is repeated to form two toner images on the same area or frame of an image member. To reduce the tendency of the first toner image to spread into the second electrostatic image and also to reduce scavenging of the first toner image by the second toning step, the image member is exposed, immediately after the formation of the first toner image, to uniform activating radiation to form charges of a polarity opposite the electrostatic image, which charges tend to hold the first toner image to the image member. The uniform exposure can be effected through a transparent support to the image member.

1 Claim, 2 Drawing Sheets

METHOD AND APPARATUS FOR FORMING A COMPOSITE DRY TONER IMAGE

CROSS REFERENCE TO RELATED APPLICATIONS

This application is related to cofiled U.S. patent application Ser. No. 08/065,246, METHOD AND APPARATUS FOR FORMING TWO TONER IMAGES IN A SINGLE FRAME, Joseph E. Guth et al, filed May 20, 1993; U.S. patent application Ser. No. 08/065,248, PRINTHEAD WRITER ASSEMBLY, Frank J. Koetter et al, filed May 20, 1993; U.S. patent application Ser. No. 08/065,249, , IMAGE FORMING METHOD AND APPARATUS, Joseph Kaukeinen et al, filed May 20, 1993; U.S. patent application Ser. No. 08/064,621, METHOD OF FORMING TWO TONER IMAGES IN A SINGLE FRAME, Eric C. Stelter et al, filed May 20, 1993; and U.S. patent application Ser. No. 08/064,626, METHOD AND APPARATUS FOR DEVELOPING AN ELECTROSTATIC IMAGE USING A TWO COMPONENT DEVELOPER, Eric C. Stelter et al, filed May 20, 1993.

BACKGROUND OF THE INVENTION

This invention relates to the formation of two or more toner images in a single frame or area of an image member. Although not limited thereto, it is particularly usable in a method and apparatus which forms accent color images on a single frame of an image member in a single pass.

U.S. Pat. No. 5,001,028 to Mosehauer et al is representative of a number of references describing a process in which a photoconductive image member is uniformly charged and imagewise exposed to create an electrostatic image. Toner is applied to the electrostatic image to create a toner image. Usually, in this process, discharged area development is used. Thus, the toner applied is of the same polarity as the electrostatic image. It deposits in the areas of lowest charge (the discharged areas) to form a toner image having a density which is greatest in the portions of the image receiving the greatest exposure.

Although not absolutely necessary in this process, the image member is, again, uniformly charged with a charge of the same polarity as the original charge and it is, again, imagewise exposed to form a second electrostatic image, generally in the portions of the image member not covered by the first toner image. The second electrostatic image is toned, again with a toner of the same polarity as the charge to create a second toner image. The process can be repeated with a third electrostatic image toned by a third color toner to cream a three color image, etc. The two (or more) color image is transferred in a single step to a receiving sheet and fused also in a single step.

Although the process is not necessarily limited to such applications, it is most commonly used to provide accent color prints or copies with laser or LED printhead electronic exposure. All commercial applications known to us use electronic exposure and discharged area development.

The process has a number of advantages in accent color applications. It eliminates the troublesome and expensive steps usually used in registering images at transfer. If it uses separate exposure stations, it can produce accent color output at the same speed as single color output.

It is important that the second and subsequent toning steps not disturb the first toner image. Otherwise, toner from the first toner image gets mixed into the second development station ("scavenging") and toner from the second development station can be deposited on the first toner image ("overtoning"). Recharging between images reduces overtoning. Much of the art prior to Mosehauer recommends use of projection toning for the second and subsequent toning steps in order not to disturb the first image. The Mosehauer patent suggests that excellent results are obtained using a high coercivity carrier in a two component magnetic brush having a rotating magnetic core. The Mosehauer approach provides high density images at high process speed with less color mixing than other high density, high speed systems.

U.S. Pat. No. 4,778,740 (Matsushita) notes a problem observed in such systems that when the second electrostatic image includes discharged areas immediately next to the first toner image, the first toner has a tendency to migrate into the second image. The solution suggested is to leave a one pixel gap from the first image in the second exposure. This can be accomplished in an electronic exposure system providing registration between the two exposures is very accurate. However, it requires excellent registration and leaves a thin, untoned area between the two images which can show up as a white streak or "halo".

U.S. Pat. No. 5,025,292 shows a system, used commercially, in which a series of color separation images are formed on a single image member using liquid developing. The first image is heated to dry it so it is fixed during the second exposure. The second exposure is made through a transparent support in order to create an electrostatic image that, in fact, overlaps the first color image, which electrostatic image is toned to form overlapping color toner images. This process is also carried out with discharged area development and the image member is recharged between images.

Many prior patents show exposure through a base of a photoconductive member for various purposes, usually associated with using the same magnetic brash to both clean and develop or trying to expose and develop at the same time. See, for example, U.S. Pat. Nos. 3,703,335; 5,159,389; and 5,053,821.

The use of erase lamps at various places in an electrophotographic process is well known. The most common uses of erase lamps is either just before the transfer station or just before the cleaning station in charged area development processes to loosen up the toner so it can be more easily transferred or cleaned. It is also known to place the erase lamp on the side of the image member opposite the toner image to better eliminate charge underneath an opaque toner so that the toner can be more easily transferred or cleaned.

SUMMARY OF THE INVENTION

In working on the problem of toner migration from the first toner image into an adjacent second electrostatic image in processes like those described above, it was found that the problem is greatly affected by charge on the image member under the first toner image. This charge originates in one of the first two charging steps. The primary source of such charge is likely to be in the second charging step. However, in gray scale imaging, substantial charge from the first charging step can still be present underneath portions of the first toner image. With discharged area development being used, this charge is the same polarity as is the charge on the toner itself. Thus, with the toner and image member being of the same polarity, there is a tendency for the toner to be repelled by the image member. If the second electrostatic image does not have a discharged portion adjacent the first toner image, the charge from the first and/or second charging steps located next to the toner image will prevent movement of the toner into that space. However, if the adjacent space is exposed in creating the second electrostatic image, that charge is dissipated and the toner is now repelled by the charge still remaining underneath the toner into the space which is no longer protected by its own charge. This is called "toner blowoff". This charge underneath the first toner image also has a tendency to encourage scavenging.

It is an object of the invention to reduce the tendency of the first toner image in such processes and apparatus to blow off into an adjacent exposed portion of the second electrostatic image and/or to be scavenged by the second toning station.

These and other objects are accomplished by a method of forming a composite toner image on an image member, which image member has a photoconductive layer on its first side and a support, which support is transparent to radiation to which the photoconductive layer is sensitive. The method includes forming a first electrostatic image of a first polarity on the first side of the image member, applying a first dry toner of the first polarity to the first electrostatic image to form a first toner image defined by the first electrostatic image. Then, the photoconductive layer is exposed to erase or reduce any portion of the first electrostatic image remaining between the image member and the first toner image. A second electrostatic image is formed on the first side of the image member, which second electrostatic image is toned to form the second toner image generally in the same frame or area containing the first toner image.

The step of exposing the photoconductive layer to reduce the first electrostatic image remaining between the image member and the first toner image prior to formation of the second electrostatic image appears to make the first toner image adhere better to the image member. It, thus, has less tendency to blow off into the discharged areas of the second electrostatic image adjacent it and to be scavenged into the second toner station. It is believed that this exposure causes charges opposite the first polarity to move through the photoconductive layer to a position adjacent the first toner image as attracted there by the residual charge remaining on the toner particles themselves in the first toner image. Although a person skilled in the art might expect a second charging step of the first polarity to overwhelm this holding charge, that has not been found to be the case. There is less toner blowoff when using this exposing step.

According to a preferred embodiment, the erasing exposure is made through the support in order to better expose the portion of the photoconductive layer under the first toner image. This appears to be more important in preventing scavenging than blowoff, because front exposure appears to diffuse or scatter around the edges of the toner image to help hold the edge toner particles from migrating.

The reduction of charge on the image member immediately after creation of the first toner image has an additional advantage. In some instances, it is easier to recharge the image member to an appropriate potential if it is first discharged. This is especially true if the desired potential for the formation of the second electrostatic image is less than that for the first image.

DESCRIPTION OF THE PREFERRED EMBODIMENTS

FIGS. 2–8 show a method of forming two dry and unfixed toner images on the same area or frame of an image member 1. The image member 1 preferably includes a transparent support 3, a conductive layer 9 and a photoconductive layer 5. The photoconductive layer is on a first side of the image member 1. The image member 1 can also contain a number of other layers including charge generation layers, charge transport layers, barrier layers and protective overcoat layers. For purposes herein, however, it is conveniently illustrated as a support with conductive and photoconductive layers. For purposes herein, the support need not be transparent to all radiation but to be used in one preferred embodiment need to be transparent only to some radiation to which the photoconductive layer is also sensitive. The conductive layer 9 is also transparent. Transparency in conductive layers is generally obtained by using normally nontransparent conductive materials but forming them in such a thin layer that they are transparent.

Except as explained below, the process described in FIGS. 2–8 generally follows the process described in U.S. Pat. No. 5,001,028 referred to above, which patent is incorporated by reference herein.

Figure 2:
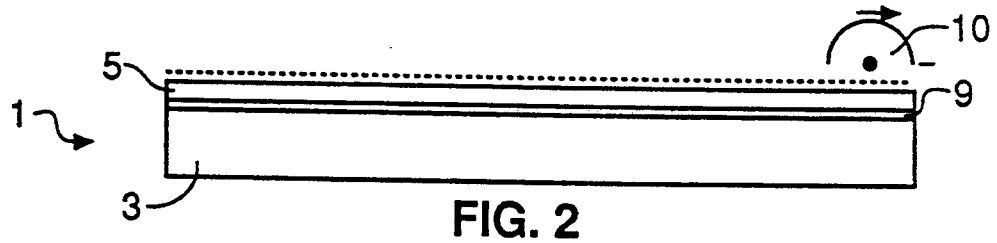
FIGS. 2–8 are side schematic sections of an image member illustrating the steps of an image forming method.
Figure 3:
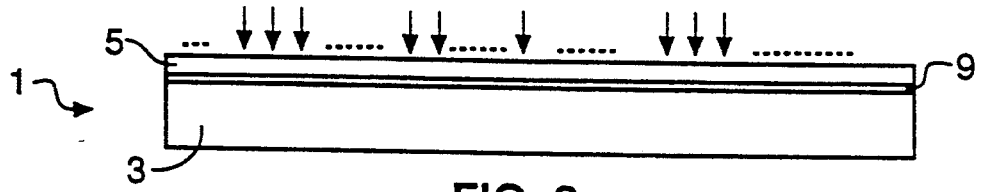
Figure 4:
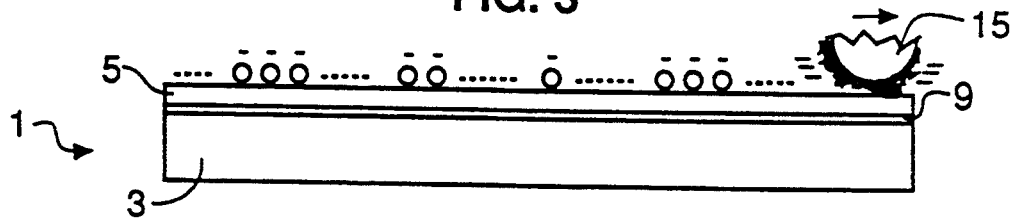

According to FIG. 2, photoconductive layer 5 is uniformly charged to a charge of a first potential, for example, a negative potential, by a charger 10. According to FIG. 3, the charged photoconductive layer is imagewise exposed to create a first electrostatic image of the first polarity. According to FIG. 4, the first electrostatic image is toned by a toning or development station 15 which applies a dry toner also having a charge of the first polarity to the image member to form a first toner image. Because the toner applied in FIG. 4 is charged the same as the charge applied in FIG. 2, the toner is attracted to the image member in an amount that is inversely proportional to the charge in the first electrostatic image. Thus, the toner forms in the portions of the first electrostatic image that are discharged in FIG. 3. If the image has substantial gradations of exposure, the first toner image will be deposited in an amount related to that exposure.

Figure 5:
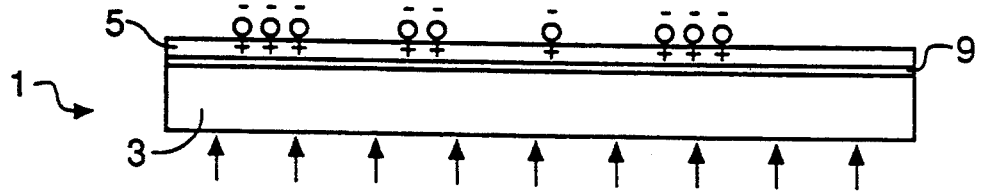

At this point in the process, the image member is uniformly exposed to radiation to which photoconductive layer 5 is sensitive, preferably through transparent support 3, as shown in FIG. 5. This uniform exposure has a tendency to reduce the charge of the first polarity on the image member, including any charge underneath the first toner image. Additionally, it is believed that charge of a second polarity opposite the first polarity moves from the conductive layer 9 toward the surface of photoconductive layer 5 as attracted there by the residual charge of the first polarity on the particles making up the first toner image. As shown in FIG. 5, this is positive charge or electron holes that have migrated to the surface or just under the surface of photoconductive layer 5 where there are particles of the first toner image. This charge has a tendency to attract the first toner image and hold it to the photoconductive layer 5.

Figure 6:
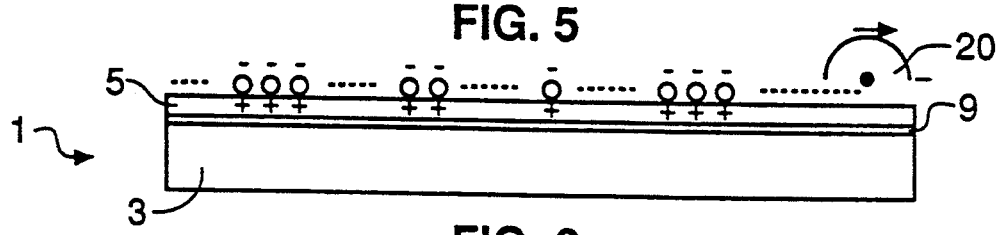
Figure 7:
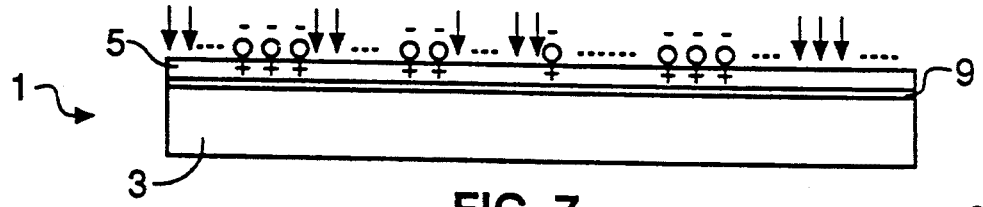

According to FIG. 6, the photoconductive layer is again uniformly charged to a charge of the first polarity. According to FIG. 7, it is imagewise exposed to form a second electrostatic image. At this point in prior processes, places which the exposure in the second electrostatic image are adjacent the first toner image appear to cause a blowoff of the first toner image into the second exposure. However, because of the step shown in FIG. 5, this blowoff is reduced. This is believed to be because some of the positive charges holding the first toner image to photoconductive layer 5 have survived the charging step shown in FIG. 6 and continue to hold that toner, inhibiting it from moving into the adjacent exposed portion of the second electrostatic image.

Figure 8:
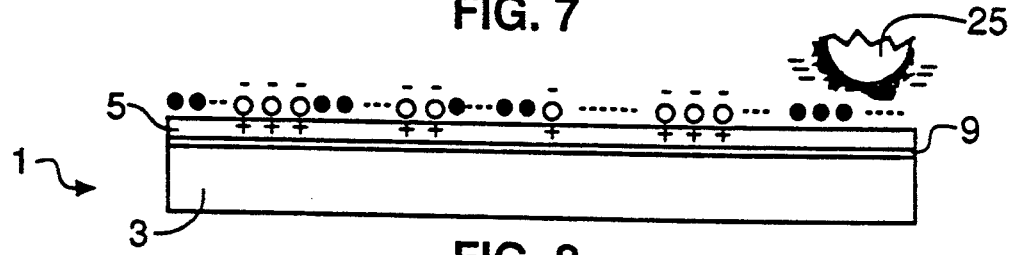

According to FIG. 8, the second electrostatic image is toned, using a toning or development device 25 which applies a toner different from the toner making up the first toner image but still of the first polarity to photoconductive layer 5. This toner, because it is of the first polarity, forms in the discharged areas of the second electrostatic image.

If the toners making up the first and second toner images are of at different color, the process forms a two color image. The steps of the process can be repeated again to form a third toner image in the same area, thereby forming a three color image.

Figure 1:
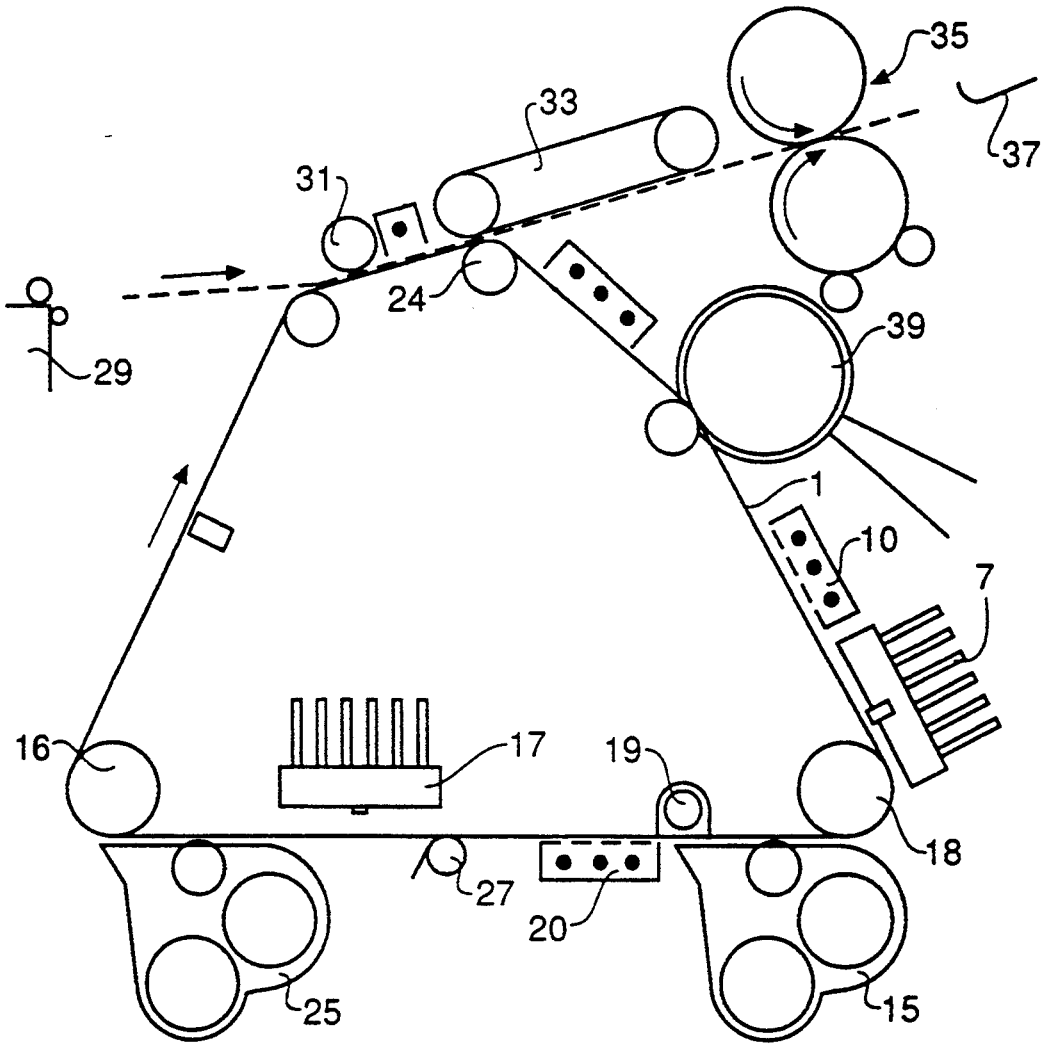
FIG. 1 is a side schematic of an image forming apparatus.

FIG. 1 shows an apparatus for carrying out the process shown in FIGS. 2–8. According to FIG. 1, image member 1 is in the form of an endless belt trained about a series of rollers, including a tension roller 16 and a drive roller 18, to continuously move through a series of electrophotographic stations well known in the art. Image member 1 is charged by charging device 10 to a uniform potential, for example, a negative potential. It is imagewise exposed by an exposure device, for example, LED printhead 7, to create a first electrostatic image. The first electrostatic image is toned at a first toning station 15 by the application of toner having a polarity the same as the original charging station 10, for example, a negative polarity. Toner, thus, is applied to image member 1 proportional to the amount of discharge by exposure station 7. The image member is then uniformly exposed by an erase lamp 19 located on a second side of the image member 1 opposite the first side where the first toner image has been formed. As explained above, this uniform exposure is believed to provide opposite polarity charges to the image member which help hold the first toner image in place through subsequent stations.

The image member is recharged by an additional charging station 20 to provide a substantially even charge on the image member of the first polarity. This charge need not be of the same potential as the charge applied by station 10 but should be of the same polarity. A magnetic scavenger 27 is positioned to attract any carrier inadvertently picked up by the image member in the first toning step. The position of scavenger 27 before toning station 25 prevents carrier used in station 15 from carrying toner into station 25.

The image member 1 is then imagewise exposed by a second exposure station, for example, a second LED printhead which is positioned inside image member 1 and exposes image member 1 through its transparent support to create a second electrostatic image. The second electrostatic image is toned by a second toning station 25 which applies toner, preferably of a color different from that applied by station 15, to create a second toner image on the image member. If the colors of the two images are different, this process forms a two color or multicolor image on the image member 1.

A receiving sheet is fed from a receiving sheet supply 29 into overlying contact with the two color toner image. The two color toner image is transferred to the receiving sheet at a conventional biased roller electrostatic transfer station 31, and the receiving sheet separates from the image member as the image member goes around a small roller 24. The receiving sheet is transported by vacuum transport 33 to a fuser 35 where the two color image is fixed to the receiving sheet. The receiving sheet is ultimately deposited in an output tray 37. The image member is cleaned by cleaning device 39 so that the process can be continued.

This apparatus provides two color images at the same speed it provides one color images. It also avoids the complexity of registering two images at a transfer station with the attended complex receiver handling.

Toning stations 15 and 25 are preferably constructed as in U.S. Pat. No. 5,001,028, referred to above. For highest quality, the first toning station 15 is spaced from the image member 1 by an amount less than the nap of the magnetic brush. The brush, thus, directly contacts the image member, providing a high quality, high density image at substantial speed. The second toning station 25 is spaced from image member 1 by enough that the nap does not directly contact image member 1. An AC component to the bias on station 25 helps provide the density desired in the second image despite the gap between the nap and the image member.

U.S. patent application Ser. No. 08/064,621, METHOD OF FORMING TWO TONER IMAGES IN A SINGLE FRAME, Eric C. Stelter et al, filed May 20, 1993, is directed to another aspect of this process, which can also improve freedom from blowoff and scavenging. More specifically, if the toner applied to the first toner image is of a relatively small particle size, for example, less than 10 microns in median particle diameter by volume, for instance, 8 microns, considerably less blowoff and scavenging is observed than with traditional accent color toners having a mean particle diameter of 12 microns or more. This approach can be used with the one shown in FIGS. 2–8. That is, if the toner is made especially small in size for the first toning station 15 and if the erasing exposure from station 19 is used, better results, with respect to both blowoff and scavenging, are observed than using either feature alone.

Referring again to FIG. 1, LED printhead 17 is positioned also to expose through support 3 in image member 1. This is a feature disclosed in U.S. patent application Ser. No. 08/065,246, METHOD AND APPARATUS FOR FORMING TWO TONER IMAGES IN A SINGLE FRAME, Joseph E. Guth et al, filed May 20, 1993, and is also a feature that reduces blowoff of toner. More specifically, if the second exposure is made through the base and is intentionally overlapped with the first exposure where exposed portions of the second image adjoin the first toner image, some of the charge underneath the first toner image at this interface can be dissipated. This also reduces the tendency of the toner to be blown into discharged areas next to it. This feature is also at least additive in value with the previous two features and can be used with it to further decrease the tendency of the first toner image to move into the second electrostatic image.

The following examples illustrate the benefits of the invention:

EXAMPLE 1

This test was run in an electrophotographic printer having an AC corona charger set for an initial photoconductor voltage of −600 volts and an LED exposure source for writing an image by discharging the image area of the photoconductor. The latent image on the photoconductor consisted of either a line document or repeated one-half inch squares generated with the LED exposure source. A development station was used to apply negatively charged black 8.8 μm toner to the exposed areas of the photoconductor, followed by an optional red LED rear erase for erasing the image through the base of the photoconductor, an optional green LED front erase, a second AC corona charger also set to apply an initial photoconductor voltage of −600 volts to a fully erased film, and a green LED front exposure source. The image was then transferred to paper and fused using conventional methods.

The line document was used for observations of blowoff. The one-half inch square document was used to measure image and film voltages. Image voltage measurements were the maximum value observed across a square. The initial exposure source, the intermediate rear or front erase lamps, and the final front exposure source all discharged the film to approximately 0 volts. The voltage of the one-half inch squares after development was approximately −275 volts and after rear erase, approximately −155 volts. Front erase had no effect on the image voltage.

If images were printed with the optional rear or front erase lamps off, the second charger off and the final front exposure off (in other words, with a conventional single image electrophotographic process), no blowoff was observed, as expected.

If images were printed with both erase lamps off, the second charger on and the final front exposure on, blowoff was observed. The image voltage was −715 volts.

If images were printed with this process but with the intermediate rear erase lamp turned on, no blowoff was observed. The image voltage was −615 volts.

If images were printed with this process but with the intermediate front erase lamp on instead of the rear erase lamp, no blowoff was observed. The image voltage was −715 volts.

The results of this example show that either an intermediate rear erase or an intermediate front erase can be used before the second charging step to prevent blowoff.

EXAMPLE 2

Using the equipment of Example 1, the voltage applied by the second charger was increased to −800 volts.

If images were printed with the intermediate rear erase lamp on, the second charger on and the final front erase lamp on, a small amount of blowoff was observed. The image voltage was −775 volts.

If images were printed with this process but with the intermediate front erase lamp on instead of the rear erase lamp, a similarly small amount of blowoff was observed. The image voltage was −855 volts.

Blowoff was approximately the same for both conditions in this example and less than that observed at an image voltage of −715 volts in Example 1. This indicates that blowoff is independent of the gross image voltage and depends on the voltage at the edge of the image. Due to light scattering in the photoconductor, the intermediate front erase probably reduces the voltage at the ends of the image even though it does not penetrate the toner or reduce the voltage in the center of the one-half inch squares. Of course, the intermediate rear erase reduces the voltage both at the edge and in the center of the image, and is the preferred means of increasing the adhesion of the image to the photoconductor so that it is not disrupted by downstream process steps.

The results of this example also indicate that if the voltage applied by the second charger is very large, blowoff will occur even if an intermediate erase is used before the second charging step. However, this upper limit is greater than the voltages usually used for the electrophotographic process.

The invention has been described in detail with particular reference to a preferred embodiment thereof, but it will be understood that variations and modifications can be effected within the spirit and scope of the invention as described hereinabove and as defined in the appended claims.

We claim:

1. Image forming apparatus for forming at least a two color toner image comprising:

means for uniformly charging the surface of a first side of an image member having a photoconductive layer associated with the surface to a charge of a first polarity, means for imagewise exposing the photoconductive layer to form an electrostatic image of the first polarity on the surface by imagewise discharge of the surface through the photoconductive layer, means for applying a first toner of a first color and the first polarity to the first electrostatic image to form a first toner image of the first color corresponding to exposed portions of the first electrostatic image, means for uniformly exposing the image member from the second side opposite the first side to reduce any portion of the first electrostatic image remaining between the image member and the first toner image, means for applying a uniform charge of a first polarity to the first side of the image member including the first toner image, means for imagewise exposing the image member to create a second electrostatic image of a first polarity, and means for applying toner of a second color and the first polarity to the second electrostatic image to form a toner image of the second color and, with the first toner image, a two color image on the image member.

* * * * *